US005080621A

United States Patent [19]

Nayes

[11] Patent Number: 5,080,621

[45] Date of Patent: Jan. 14, 1992

[54] WATER WALKING DEVICE

[76] Inventor: Alan W. Nayes, 180 City Blvd., West, No. 2-311, Orange, Calif. 92668

[21] Appl. No.: 555,518

[22] PCT Filed: May 22, 1990

[86] PCT No.: PCT/US90/02915

§ 371 Date: Jun. 25, 1990

§ 102(e) Date: Jun. 25, 1990

[51] Int. Cl.[5] ..... B63B 35/83

[52] U.S. Cl. ..... 441/77; 441/76

[58] Field of Search ..... 441/65, 75-77, 441/79

[56] References Cited

U.S. PATENT DOCUMENTS

| | | | |
|---|---|---|---|
| 216,234 | 6/1879 | Soule | 441/77 |
| 1,719,059 | 7/1929 | Krupka | 441/77 |
| 2,940,090 | 6/1960 | Fournier | 441/77 |
| 3,479,674 | 11/1969 | Beymer | 441/77 |
| 3,541,623 | 11/1970 | Duda | 441/77 |
| 3,936,897 | 2/1976 | Schaumann | 441/77 |
| 3,952,353 | 4/1976 | Word | 441/77 |
| 4,117,562 | 10/1978 | Schaumann | 441/77 |
| 4,698,039 | 10/1987 | Watsorf | 441/77 |

*Primary Examiner*—Joseph F. Peters, Jr.
*Assistant Examiner*—Clifford T. Bartz
*Attorney, Agent, or Firm*—Albert O. Cota

[57] ABSTRACT

A water walking device which has a pair of buoyant hulls (20), longer than they are wide, with a number of propulsion flaps (22) mounted on the bottom. The flaps are hinged and fold into the hull creating cup-like resistance chambers when hinged open to offset the rearward force of the wearer. The flaps rotate inwardly when the hull is urged forward allowing the wearer to be propelled forward by a walking action. A footwell (30) is located in each hull with the bottom below the waterline and near the center of gravity. A resilient shoe (32) attached into the footwell provides a removable connection between the wearer and the device. A propulsion fin (52) under the footwell provides stability and optionally a pair of side panels (54) extend the surface and function in the same manner as the flaps. A storage compartment (56), handles (620) a removable stabilizing arm (72) and a seat (78) may be added for ease of operation and comfort.

24 Claims, 4 Drawing Sheets

WATER WALKING DEVICE

TECHNICAL FIELD

The present invention relates to devices for allowing a person to walk on water in general. More specifically, to a pair of buoyant hulls with propulsion flaps permitting the user to simulate a walking stride for propulsion.

This application is identical to PCT application PCT/US90/02915 filed May 22, 1990 which is a continuation-in-part of PCT application PCT/US89/02390 filed May 30, 1989 now abandoned.

BACKGROUND ART

The desirability to utilize a device that allows one to walk on the water by his own power has been existent for well over a century as exhibited by an issued patent as early as 1879. While this apparatus did not reach popularity, the search has not by any means ended. The problem has existed in the prior art to make swinging flaps of such a combination as to create the proper water resistance at the right time, also sufficient stability in the buoyant hulls to allow the user to stand erect while operating the device.

A search of the prior art did not disclose any patents that read directly on the claims of the instant invention, however, the following U.S. patents are considered related:

| PATENT NO. | INVENTOR | ISSUED | | |
|---|---|---|---|---|
| 4,698,039 | Watson | 6 | October | 1987 |
| 3,952,353 | Word | 27 | April | 1976 |
| 3,936,897 | Schaumann | 10 | February | 1976 |
| 3,541,623 | Duda | 24 | November | 1970 |
| 1,719,059 | Krupka et al | 2 | July | 1929 |
| 216,234 | Soule | 3 | June | 1879 |

Watson teaches pair of flats having a footwell on the top and an I-beam on the bottom. A number of flaps are hinged to the web on each side in mating pairs and pivot from open to closed about 90 degrees relative to the web. The longitudinal axis of the I-beam is parallel to the float and functions as a keel. The footwell contains separate toe and heel supporting elements.

Word discloses a one-piece flexible inflatable device for converting a water ski to a water walking apparatus. Word's approach is to utilize an inflatable tube that, when pressurized, engages the entire periphery of the water ski. A number of flexible cups are attached to the tube and are shaped so as to catch water, thereby resisting backward movement and collapsing when forward motion is exerted by the user. The water ski supplies the foot attaching means and the structural support.

Schaumann utilizes a rigid elongated base member and at least one buoyant flotation member carried by the base member with the ability to add flotation members according to the weight of the user. These flotation members are detachably secured in order to accomplish this utility. The apparatus further contains a pair of laterally spaced longitudinally extending keels and a retard mechanism swingable about the vertical axis to start the walking movement. Further guides permit parallel movement relative to each other.

Duda uses a floatable solid substance formed into a pair of long narrow shoes, each having instep and heel straps to hold the wearer's feet. The front of the shoe is upturned in a ski-like manner and a series of equi-spaced transversely-arranged pockets or recesses extend upwardly into the shoe in tear drop fashion. The pockets offer no resistance in forward movement, as the entire shoe is lifed forwardly above the water and the pockets cause the shoes to firmly engage the water on the rearward movement. When moving forward, as in walking, one shoe is emptied of water while the other is filling providing the driving resistance required for propulsion.

Krupka et al employ a skeleton of structural members covered with a watertight envelope or coat. An opening in the frame allows the wearer's foot to enter the shoe and a tubular extension covers the leg and is closed at the top around the calf. A number of pocket shaped extensions are formed into the envelope creating swinging flaps. Wire insertions in the pliable material of the flap maintain the pocket shape so that the flaps fold in the forward direction and create resistance rearwardly.

Soule discloses a pair of boat shaped skates fastened to each foot with hinged stops on the underside, so as to prevent one skate from slipping backward in the water as the other skate is moved forward. The apparatus has a rod with a crank on one end allowing the stops to be reversed in their travel allowing the skate to move in either direction.

While all of the above prior art employs some type of resistance flaps or pocket, it is clear that the problem was not completely solved in the combination of both stability and propulsion.

DISCLOSURE OF THE INVENTION

Since the principle of walking on the water with some type of buoyant device has been known for such a long time the practicality in obtaining speeds that are desirable had to be overcome in order for the concept to be useful. It is, therefore, a primary object of the invention to obtain speeds of up to 5 miles per hour (8 KM per hour) by simple walking movement of the user. This ability is achieved by the use of a large number of propulsion flaps having a raised leg on each side creating a scoop that acts to allow sufficient resistance on the back step while completely folding away for an effortless glide in the forward step. The difference in the approach of the prior art is in a combination of the proper number and the size of flaps which are wide enough to almost cover the entire bottom and, yet, of a length (as measured from a fixed axis of rotation) that permits a full stroke to be taken while folding without interfering with the adjacent flap. It has been found that a minimum ratio of 1.5:1 width to length, has proven optimum and achieved the goal. It should also be noted that this optimum flap width/length ratio provides sufficient resistance for forward propulsion but does not allow the buoyant device too much back movement before the propulsion flap reaches its fixed position. Prior art also has been unable to capitalize on the cupping action of the claps as side legs have not been used to any extent allowing the full thrust of the water to be captured by the flap. Further, it has been found that this cupping action combined with alternately long and short flaps provide a optimum surface allowing the long flaps to provide the primary forward thrust and the small flaps to aid in the maneuverability of the device.

An important object of the invention is directed to the stability in the water which is due to not only the flat bottom, but the use of a fin disposed directly beneath the user's feet which provides both linear and lateral stability. Further, the user's feet are below the water line and very near the bottom of the hull, actually right on top of the fin. A novel footwell also allows one's ankles to stabilize the device as the top of the footwell in only narrow enough to get one's foot in, allowing the ankle to touch the resilient sides when the device beings to tip from one side to the other.

Another object of the invention is the ability to disengage the device if the user falls into the water. The foot is placed in a resilient shoe much like a wetsuit boot with the front portion cut away and either hook and loop tape (VELCRO) fastening the top together or a spring like clip around the open top portion and the sole is attached to the bottom of the footwell with a plate holding the foot tightly in place. In the event of overturning, the user simply relaxes his foot and pulls it away from the resilient shoe separating the VELCRO or opening the clip. Since it is possible to fill the footwell with water, a one-way check valve drains the water out by simply lifting the hull upward allowing the unwanted water to discharge freely and, yet, sealing when returned to its normal position.

Still another object of the invention provides a device that is small and light enough to be easily transported on top of a car or in a station wagon, van, or the bed of a pick-up. The hull of each device is preferably fabricated of polyurethane foam covered with fiberglass or carbon fiber, which is strong and yet lightweight enough to be handled by one person easily.

Yet another object of the invention affords a well balanced exercise for the entire body, as the legs, torso and arms are used to propel the device.

A further object of the invention allows a number of helpful ancillary devices to be added, such as a seat, a stabilizer arm, a strap for tying the hulls together, a leg tether, a storage compartment, grips or handles for grasping, flaps securing tensioning member or detent snap, sails, and so on.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
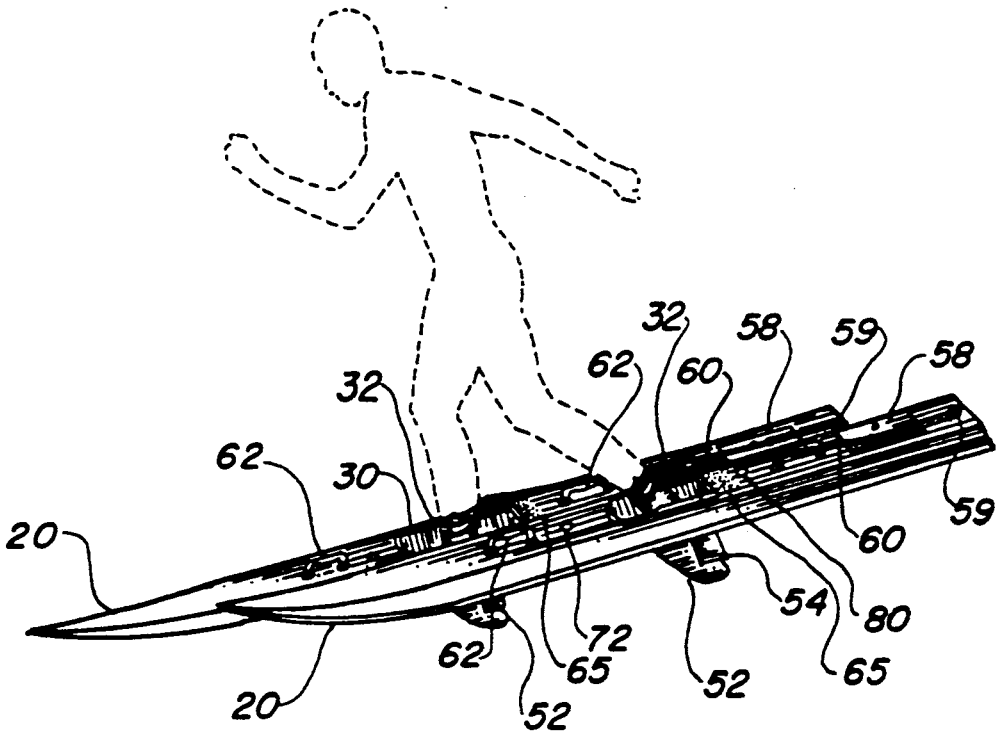
FIG. 1 is a partial isometric view of the preferred embodiment as used to walk on water.

The best mode for carrying out the invention is presented in terms of a preferred embodiment. The preferred embodiment, as shown in FIG. 1 through 24, is comprised of pair of hulls 20 having a length longer than their width. The hulls 20 are preferably constructed of a polyurethane foam covered by fiberglass, while polyurethane is favored, any type of lightweight cellular material may be used and any type or resin or similar covering is acceptable. Actually, the construction materials are not limited to even the above, as many different types and composites including hollow hulls, may be employed with equal ease and utility. FIGS. 2 and 11, 13, 14, 23 and 24 illustrate the hull 20 with its contoured top, flat bottom and sides. In designing the hulls, it was found that a length of 84 inches (215 cm) and a width (denoted as $W_D$=width of buoyant device) of 11.0 inches (28 cm) is optimum for supporting the weight of an average person. However, other dimensions with similar length/width ratios may also be utilized.

Figure 12:
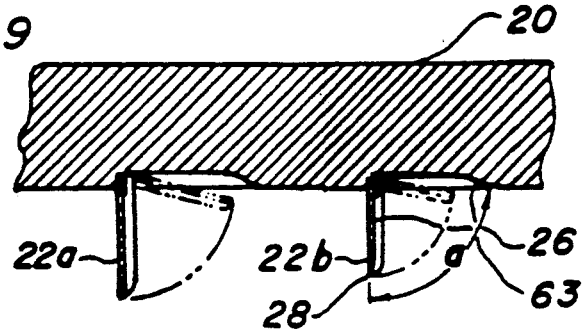
FIG. 12 is a partial side elevational view of one of the flaps with the rotation illustrated by directional lines and illustrates a small scoop to facilitate the flow of water under the propulsion flap.

One of the most important elements in the invention is the propulsion system which is capable of creating sufficient resistance in the water to allow the device to function. This system consists of a plurality of hinged rearwardly swinging propulsion flaps 22 mounted on the bottom of the hull 20. The flaps 22 are connected on the forward edge with a hinge 24 allowing the flap to rotate downward from the hull 20. It has been found that an angle no greater than 90 degrees from the hull 20 allows the optimum surface area for water resistance. This angle is illustrated in FIG. 12, referenced "a" for identification. The configuration of the flaps 22 is important for proper functioning, which includes a width to length ratio of no less than 1.5 to 1. This ratio is taken with the length of the flap parallel to the length of the hull 20 and the width being transverse with the hull allowing the flap to completely fold flat when in the forward stroke. The flap 22 in order to function, rotates along an arc defined by the formula:

$$c' = \frac{\pi r}{2}$$

where $c'$ = circumference of arc $\pi = 3.14$ $r$ = length of flap from fixed axis of rotation.

The greatest efficiency is realized when r is equal to or less tha $W_D$ and when the flaps ($r \leqq W_D$) are positioned no less than (dependent on number of flaps) one flap per 18 inches (45.7 cm) of buoyant device in the displaced water. Under this condition, the ratio of the number of propulsion flaps to 1.5 feet (in length) of buoyant device is greater than or equal to 1.

If the flap 22 is too long or not angled as described above, a full cycle is not completed and the desired speed of the device may not be reached. Each flap 22 further contains a pair of upwardly depending side legs 26, best illustrated in FIGS. 21 and 22. These legs 26 are on the edges parallel with the hull 20 and assist in creating a cup-like resistance chamber when the device is forced rearwardly. The flaps 22 rotate into the hull 20 and pockets in the hull receive the legs 26 allowing the entire flap to be flush with the bottom surface. Each flap 22 contains a bevel 28 on the rear actuating side such that the water is easily penetrated allowing the flap to open on the rearward thrust. The hull 20 contains a scoop 63, illustrated in FIG. 12 to facilitate the flow of water under the propulsion flap.

Figure 2:
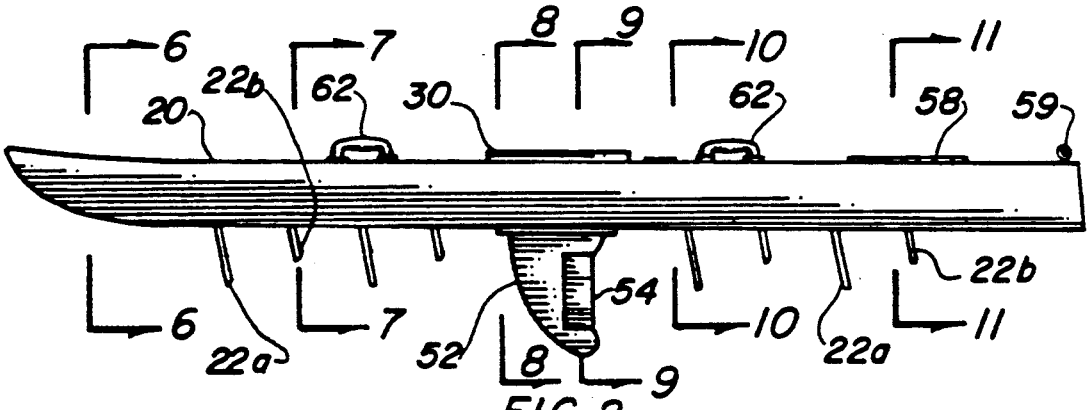
FIG. 2 is a side view of the preferred embodiment.
Figure 3:
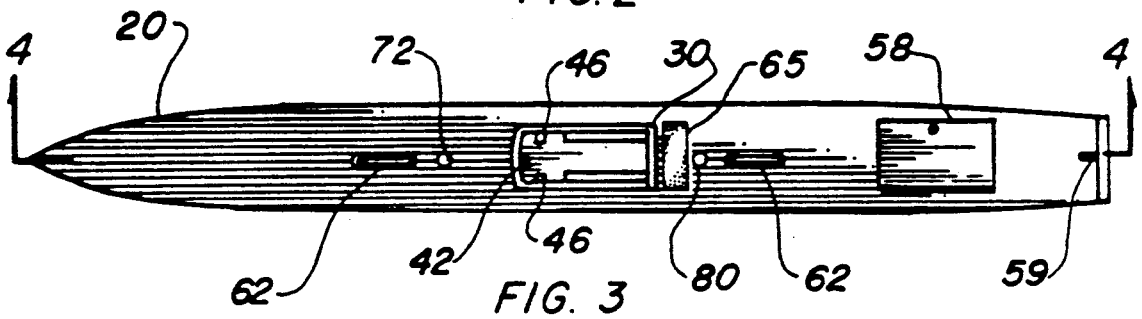
FIG. 3 is a plan view of the preferred embodiment.
Figure 4:
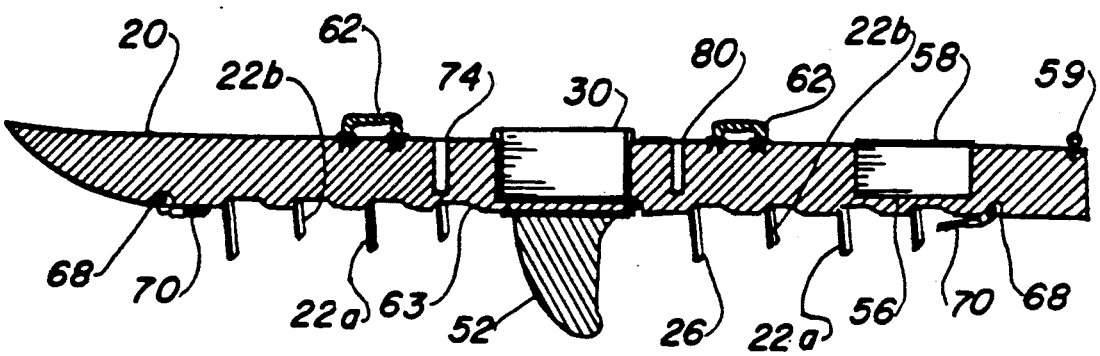
FIG. 4 is a cross-sectional view taken along lines 4—4 of FIG. 3 taken along the centerline illustrating the internal structure of the hull.
Figure 5:
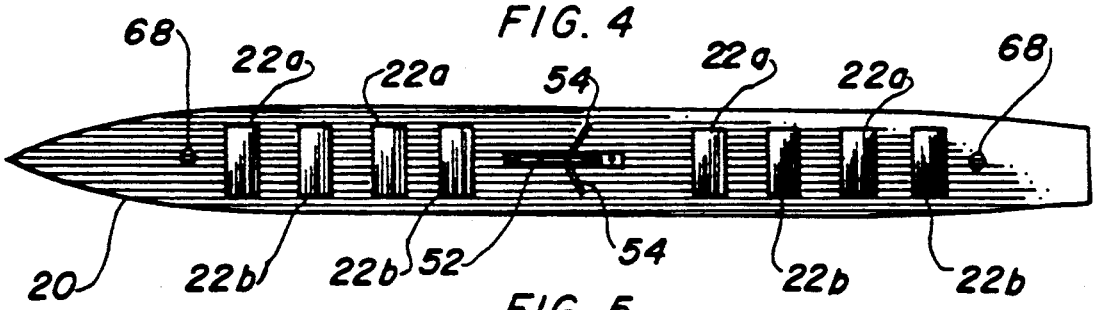
FIG. 5 is a bottom view of the preferred embodiment with the fin side panels in the open position.
Figure 6:
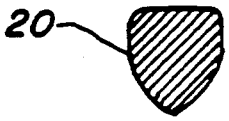
FIG. 6 is a cross-sectional view taken along lines 6—6 of FIG. 2.
Figure 7:
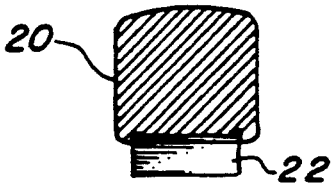
FIG. 7 is a cross-sectional view taken along lines 7—7 of FIG. 2.
Figure 8:
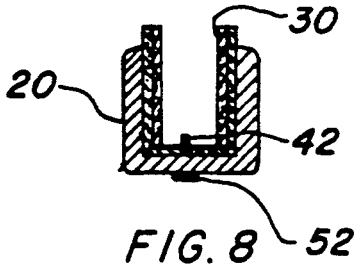
FIG. 8 is a cross-sectional view taken along lines 8—8 of FIG. 2.
Figure 9:
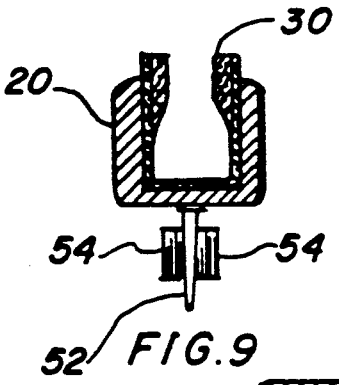
FIG. 9 is a cross-sectional view taken along lines 9—9 of FIG. 2 illustrating the interior cross-section of the footwell.
Figure 10:
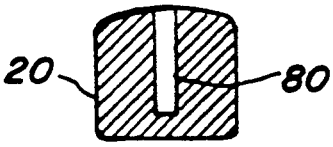
FIG. 10 is a cross-sectional view taken along lines 10—10 of FIG. 2.
Figure 11:
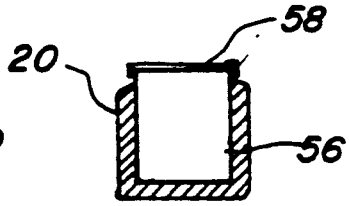
FIG. 11 is a cross-sectional view taken along lines 11—11 of FIG. 2 depicting a cross-section of the storage compartment.
Figure 23:
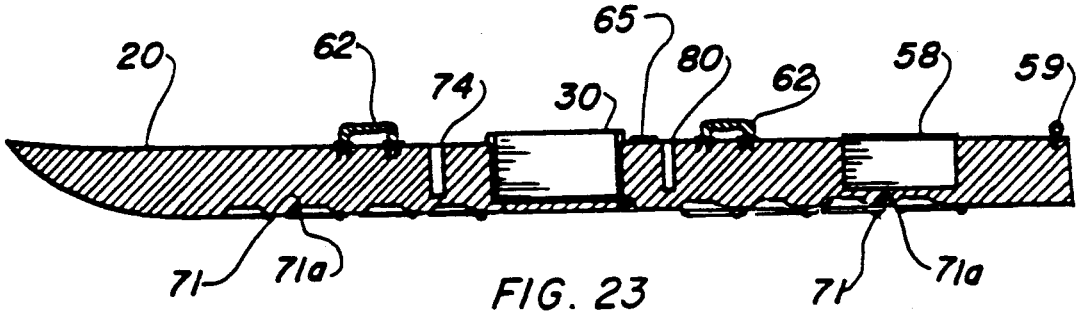
FIG. 23 is a cross-sectional view taken along the longitudinal centerline of one of the devices with the fin removed and the flaps snapped closed for storage or transportation.
Figure 24:
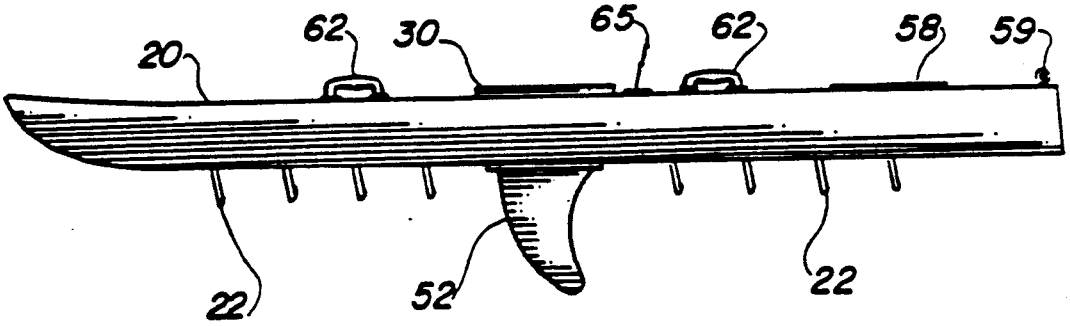
FIG. 24 is a side view of the hull with all of the propulsion flaps the same length and the stabilizing fin without side panels attached.

It has been found that some benefit may be gained by using a combined plurality of long flaps **22*a* and short flaps 22*b* alternately positioned upon each hull 20. The long flaps 22*a* provide the primary forward thrust as previously explained and the short flaps 22*b* contribute to the inventions maneuverability. FIGS. 2 and 4 illustrate this embodiment while FIG. 24 depict the same length flaps 22 in the entire sequence. The flaps may contain one or more detent snaps 71 affixed to the underside of the flap and a mating detent receptacle 77*a* is attached to the hull 20 as depicted in FIGS 21-23** for securing the flaps during transportation.

Figure 21:
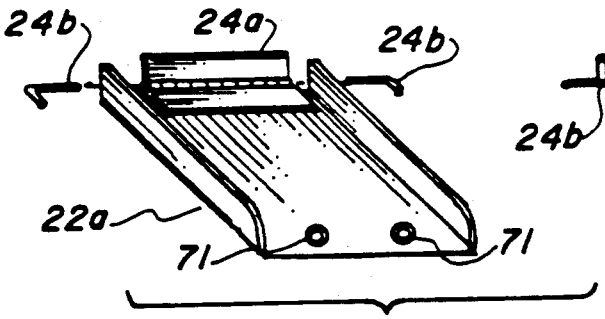
FIG. 21 is a partial isometric view of the large propulsion flap with the removable release shown broken away completely removed from the invention for clarity.
Figure 22:
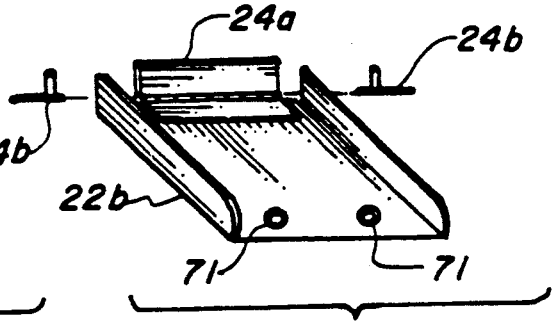
FIG. 22 is a partial isometric view of the small propulsion flap with the removable release shown broken away completely removed from the invention for clarity.

For convenience in repair or replacement, the flap 22 may be removable using a detachable hinge **24*a* with spring loaded press axle 24*b* as shown, removed from the hull 20 in FIGS. 21 and 22. This feature increases the maintainability of the invention as the flaps 22** may be inadvertently damaged with improper care.

Figure 17:
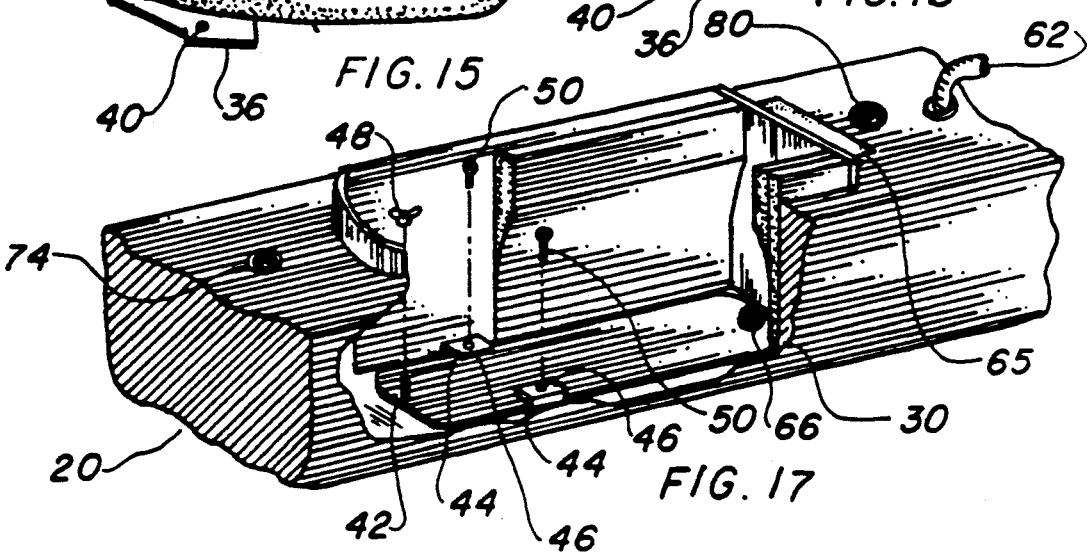
FIG. 17 is a partial cut-away view of the hull in the area of the footwell illustrating the inside of the footwell and the shoe attaching means.

A footwell 30 is located in each hull 20 slightly wider and longer than one's foot. The footwell 30 penetrates the hull 20 to a depth below the water line and near the hull center of gravity. FIG. 17 illustrates by a cut-away view, the internal shape of the footwell 30 which is narrower at the top than the bottom allowing one's foot to enter conveniently, however, to be close enough to the ankle to provide support decreasing the susceptibility of tipping in the water. The entire sides are preferably lined with a resilient material to provide user comfort as the ankle touches the sides during the walking process.

Figure 15:
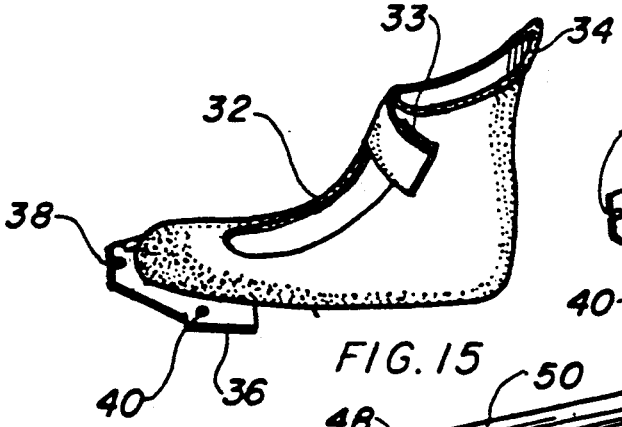
FIG. 15 is a partial isometric view of the resilient shoe with the hook and loop closure completely removed from the device for clarity.
Figure 16:
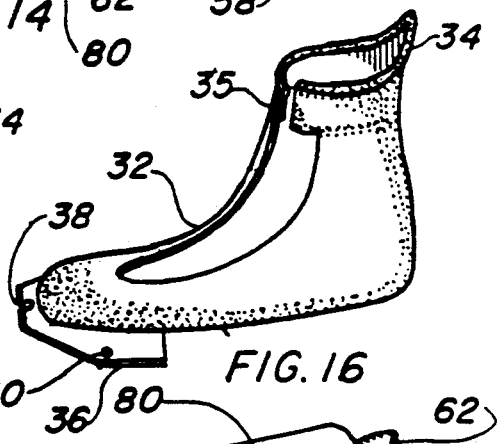
FIG. 16 is a partial isometric view of the resilient shoe with an integral spring ankle support.

In order to maintain the user's foot in the footwell 30, a resilient shoe 32 is employed. This shoe is much like that of a wet suit boot with the front section cut out allowing the dorsum of the foot to be free and unrestricted. Thereby preventing injuries in the event of a fall. Without the resilient shoe 32 such a fall could easily result in various types of lower extremity injuries. In order to attach or hold the user's foot into the shoe 32 any convenient method may be used as an example, FIG. 15 illustrates a shoe with hook and loop tape 33, so called VELCRO by its registered trademark, connected at the top of the shoe near the wearer's ankle. FIG. 16 further depicts another embodiment of the attachment using an integral resilient spring like U-shaped rear ankle support 35. Other fasteners, well known in the art, may be used with equal ease. In any event, if the user falls or wants to become detached from the invention, the fastening device is simply opened by pulling the foot away from the shoe or in the hook and loop tape 33 embodiment manually disengaging if desired, otherwise, in case of a fall this is automatically accomplished.

FIGS. 15 and 16 illustrates this shoe 32 completely removed from the invention for clairty. This shoe 32 further has an elongated counter 34 to assist in grasping the back for pulling one's foot into place. The bottom of the shoe 32 contains attaching means in the form of a plate 36 permanently affixed to the sole, having a notch 38 in the front toe are and a pair of holes 40 one on each side near the widest part. The footwell 30 contains an upstanding stud 42 in the front of the bottom and an over extending side clamp 44 on each side. The side clamps 44 further contain a threaded bore 46 in the center thereof. The attachment is made by slipping the shoe 32 into the side clamps 44 simultaneously from the back while the notch 38 aligns with the stud 42. A wingnut 48 is threaded onto the stud 42 and a pair of thumbscrews 50 are screwed into the bore 46 in each clamp 44. FIG. 17 again, illustrates this connection with the thumbscrews 50 and wingnut 48 shown removed as indicated by phantom lines. While this embodiment of the shoe attaching means is disclosed, any type of attachments may be made with equal ease, such as over center devices, hook and loop tape, clamps, hooks, threaded fasteners, straps buckles and a myriad of other fasteners well known in the art.

Figure 18:
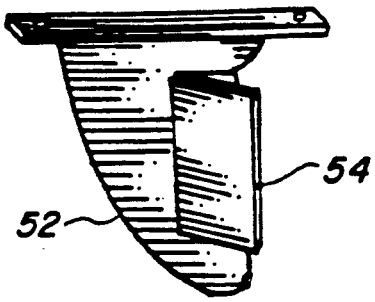
FIG. 18 is a partial isometric view of the propulsion fin having side panels, the fin completely removed from the invention for clarity.
Figure 19:
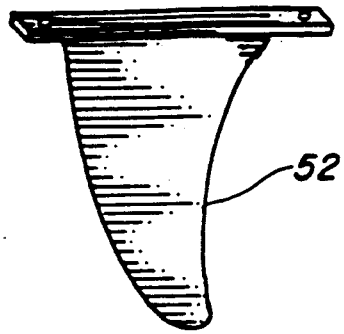
FIG. 19 is a partial isometric view of the stabilizing fin without panels, the fin completely removed from the invention for clarity.

A propulsion fin 52 is mounted under the footwell 30 of each hull 20. The fin 52 is shaped like a rudder and is at right angles from the bottom of the hull 20 producing a stabilizing and directional effect to the device when moving in the water. Alternatively, an arcuating side panel 54 is mounted in a recess on each side of the fin with a hinge. These panels 54 function in the same manner as the flaps 22 extending the surface when forced rearwardly and folding flat against the fin 52 when slid forward. The fin 52 may or may not include the flaps 22 as illustrated in FIGS. 18 and 19 as the flaps add additional surface, the cost impact may preclude their use and the basic function remains intact. In any event, the fin 52 is either fixed permanently or preferably is removable to facilitate transportation and storage.

Not necessary for the invention but adding to the utility of the invention is a covered storage compartment 56 that may be located within each hull 20 directly behind or in front of the footwell 30. This compartment would allow stowing of the user's gear or other ancillary equipment and is complete with a watertight hinged door 58.

A hull mooring member 59 in the form of an eyebolt, or the like, is positioned on top of the hull 20 on the stern allowing for fastening the device to the shore, dock, or used for attaching other equipment.

An ankle tether 60 may be utilized, as shown in FIG. 1, to attach the device to the user in the event that the operator falls into the water. The tether 60 is well known being used on surfboards, and the like, and may be conveniently attached to the above mooring member 59 or other appendage on the hull 20.

One or more handles 62 are mounted on the hull 20 to hold the hulls together or to grasp in emergencies, also for normal handling. A connecting strap 64, illustrated in FIG. 14, ties the hulls 20 together for stability when entering.

A hand grip 65 may be added to the top of the hull 20 immediately to the rear of the footwell 30. This grip 65 may be of any suitable material and forms a surface for gripping when the user mounts the device from the water as the hull is smooth and slippery.

Figure 20:
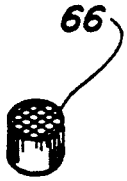
FIG. 20 is a partial isometric view of the check valve completely removed from the invention for clarity.

A one-way check valve 66, as shown in FIGS. 4, 17 and 20, is positioned between the bottom of the footwell 30 and the underside of the hull 20 allows water trapped inside the footwell to be drained by lifting one hull above the water level. The check valve 66 may be any type suitable for the application, such as those using balls and resilient seats, or the like, well known in the art.

In order to conveniently transport the device, flap securing means may be used. This securement may be accomplished by the use of pair of keepers 68 embedded in the hull 20 adjacent to the first and last flap 22 and a tension member 70 connected to the keepers 68 and stretched tightly inbetween. The member 68 may be elastic or flexible with hooks or buckles to create the tension between the keepers 68. FIG. 4 illustrates this securing means with the member 70 cut-away for clarity to allow the flaps 22 to be shown in their open position. Another embodiment of the securing means to retain the flaps 22 is illustrated in FIGS. 21 and 22 and consists of one or more detent snaps. FIG. 23 shows the previously identified snaps and receptacles connected together and it should be also noted that types of fasteners well known in the art, may be used with equal ease and efficiency.

Figure 13:
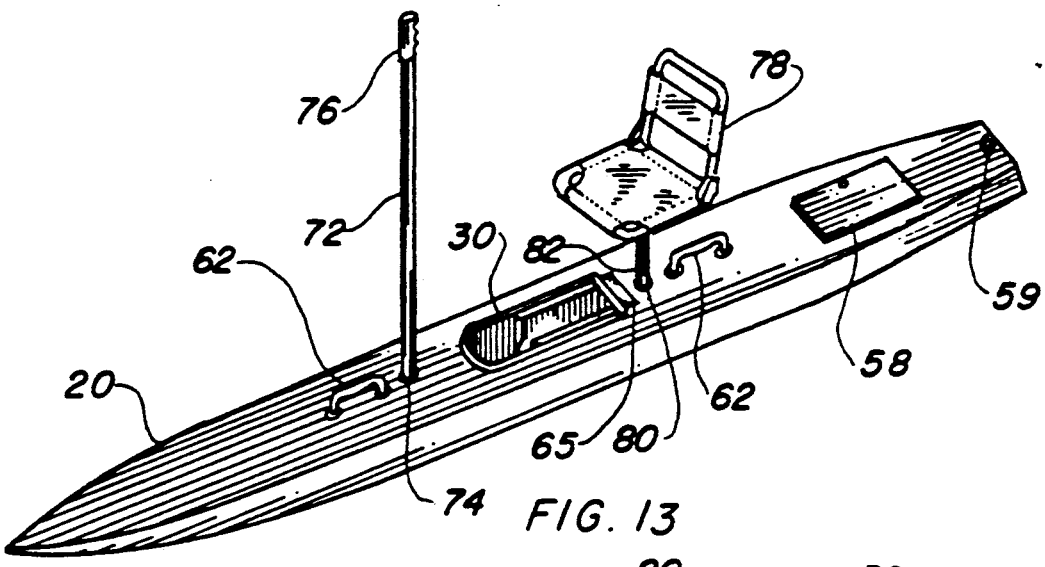
FIG. 13 is a partial isometric view of the preferred embodiment with the accessories in place.
Figure 14:
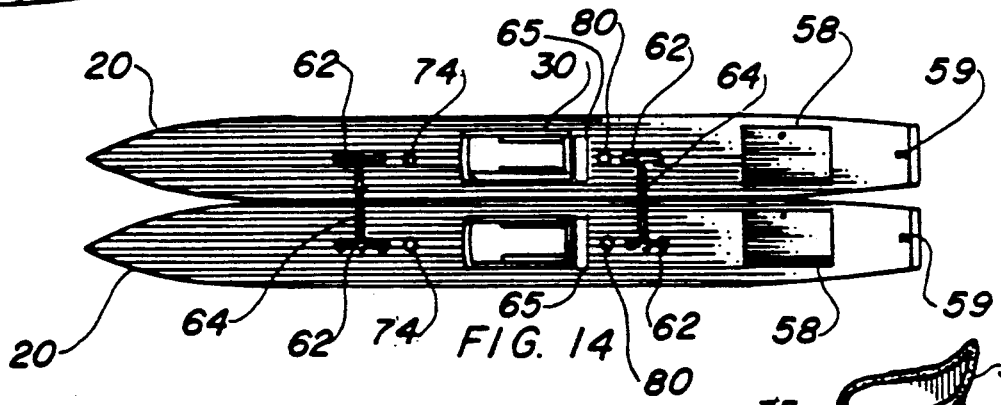
FIG. 14 is a plan view of two hulls tied together for stability.

A stabilizing arm 72, shown in FIG. 13, is mounted in a first socket 74 adjacent to each footwell 30. The arm contains a grip 76 on the uppermost end with the arm used for grasping to assist in stabilizing the hull 20. These arms 72 are removable and may be taken apart for storage within the compartment or may be solid and stored elsewhere.

A seat 78 may also be mounted in the hull 20 in a second socket 80, not unlike the first socket 74, for the arm 72. This seat 78 or chair may be a simple flat surface or may have a seat and a back, as illustrated in FIG. 13. In any event, the flat surface is supported by a leg 82 that slips into the second socket 80 making the apparatus removable. It will be seen that any type of seating device could be acceptable for the application.

In use, the hulls 20 are individually placed in the water. The user then places his feet in the resilient shoes 32 which have been previously secured in the footwell 30 by attaching them into place with the wingnut 48 and thumbscrews 50. The device is then launched and the user places one foot in front of the other in a walking stride and, as previously described, the flaps 22 and fin side panels 54 rotate at the proper time to allow the rearward thrust to function propelling the user over the water as if he were walking on land.

While the invention has been described in complete detail and pictorially shown in the accompanying drawings, it is not to be limited to such details, since many changes and modifications may be made in the invention without departing from the spirit and the scope thereof. Hence, it is described to cover any and all modifications and forms which may come within the language and scope of the appended claims.

I claim:

1. A buoyant device for walking on the surface of water comprising:

(a) a pair of hulls having a length longer than their width, and each having sufficient buoyancy to support the weight of a person while standing on the hulls in the water, (b) a plurality of hinged rearwardly swinging propulsion flaps having their length parallel to the hull length and further having upwardly depending side legs on edges thereof parallel with the hull, each propulsion flap creating a cup-like resistance chamber when urged forward by the action of a person's feet in a walking motion alternatively allowing one hull to slide forward effortlessly and the other to resist the water on the flaps, propelling the wearer forward, (c) a footwell in each hull having a top and a bottom, the footwell being wider and longer than a person's foot and disposed through an upper surface of the hull with the bottom below the water line near the hull center of gravity, further the footwell is narrower at the top than the bottom such that a person's foot may enter and yet provide support for a person's ankle, thereby decreasing the susceptibility of tipping, (d) a resilient shoe having attaching means, removably fastened to the bottom of each footwell providing means to maintain a person's foot therein and yet allow freedom of movement for the walking activity creating propulsion for the device, and, (e) a propulsion fin disposed under each footwell having swinging side panels on each vertical surface providing stability in the water and increased surface when forced rearwardly, also said side panels folding flat against the fin when slid forward providing the same relative action as said propulsion flaps.

2. A buoyant device for walking on the surface of water comprising:

(a) a pair of hulls having a length longer than their width, and each having sufficient buoyancy to support the weight of a person while standing on the hulls in the water, each hull further comprising a fiberglass outer skin over a polyurethane foam inner structure providing a structural composite capable of supporting a person's weight, (b) a plurality of hinged rearwardly swinging propulsion flaps having their length parallel to the hull length and further having upwardly depending side legs on edges thereof parallel with the hull, each propulsion flap creating a cup-like resistance chamber when urged forward by the action of a person's feet in a walking motion alternatively allowing one hull to slide forward effortlessly and the other to resist the water on the flaps, propelling the wearer forward, (c) a footwell in each hull having a top and a bottom, the footwell being wider and longer than a person's foot and disposed through an upper surface of the hull with the bottom below the water line near the hull center of gravity, further the footwell is narrower at the top than the bottom such that a person's foot may enter and yet provide support for a person's ankle, thereby decreasing the susceptibility of tipping, (d) a resilient shoe having attaching means, removably fastened to the bottom of each footwell providing means to maintain a person's foot therein and yet allow freedom of movement for the walking activity creating propulsion for the device, and, (e) a propulsion fin disposed under each footwell having swinging side panels on each vertical surface providing stability in the water and increased surface when forced rearwardly, also said side panels folding flat against the fin when slid forward providing the same relative action as said propulsion flaps.

3. The buoyant device as recited in claim 1 wherein said propulsion flaps further comprises a bevel on a side opposite said hinge such that the water is easily penetrated and rotates the flap open when rearward thrust is imposed on the hull by the walking action of a person.

4. The buoyant device as recited in claim 1 wherein said propulsion flaps further comprise an angle no greater than 90 degrees from the hull when in the rearwardly arcuated position allowing optimum surface area for water resistance during the propulsion movement and, yet, rotate into the hull on the forward action without interference from the other flaps.

5. A buoyant device for walking on the surface of water comprising:

(a) a pair of hulls having a length longer than their width, and each having sufficient buoyancy to support the weight of a person while standing on the hulls in the water, (b) a plurality of hinged rearwardly swinging propulsion flaps having their length parallel to the hull length and further having upwardly depending side legs on edges thereof parallel with the hull, each propulsion flap creating a cup-like resistance chamber when urged forward by the action of a person's feet in a walking motion alternatively allowing one hull to slide forward effortlessly and the other to resist the water on the flaps, propelling the wearer forward, (c) a footwell in each hull having a top and a bottom, the footwell being wider and longer than a person's foot and disposed through an upper surface of the hull with the bottom below the water line near the hull center of gravity, further the footwell is narrower at the top than the bottom such that a person's foot may enter and yet provide support for a person's ankle, thereby decreasing the susceptibility of tipping, (d) a resilient shoe having attaching means, removably fastened to the bottom of each footwell providing means to maintain a person's foot therein and yet allow freedom of movement for the walking activity creating propulsion for the device, and, (e) a propulsion fin disposed under each footwell having swinging side panels on each vertical surface providing stability in the water and increased surface when forced rearwardly, also said side panels folding flat against the fin when slid forward providing the same relative action as said propulsion flaps, said propulsion flaps have a relative position greater than or equal to one flap per 1.5 feet of displaced water along the length of each of the pair of hulls said flap rotating on a circumference of an arc defined by $$\frac{\pi r}{2}$$

where r is equal to or less than the flap width ($W_D$) and further having a flap width to length ratio of no less than 1.5 to 1.

6. A buoyant device for walking on the surface of water comprising:

(a) a pair of hulls having a length longer than their width, and each having sufficient buoyancy to support the weight of a person while standing on the hulls in the water, (b) a plurality of hinged rearwardly swinging propulsion flaps having their length parallel to the hull length and further having upwardly depending side legs on edges thereof parallel with the hull, each propulsion flap creating a cup-like resistance chamber when urged forward by the action of a person's feet in a walking motion alternatively allowing one hull to slide forward effortlessly and the other to resist the water on the flaps, propelling the wearer forward, said propulsion flaps further comprise a combined plurality of long flaps and a plurality of short flaps alternately positioned upon each hull with the long flaps providing a primary forward thrust and the short flaps contributing to the maneuverability, (c) a footwell in each hull having a top and a bottom, the footwell being wider and longer than a person's foot and disposed through a upper surface of the hull with the bottom below the water line near the hull center of gravity, further the footwell is narrower at the top than the bottom such that a person's foot may enter and yet provide support for a person's ankle, thereby decreasing the susceptibility of tipping, (d) a resilient shoe having attaching means, removably fastened to the bottom of each footwell providing means to maintain a person's foot therein and yet allow freedom of movement for the walking activity creating propulsion for the device, and, (e) a propulsion fin disposed under each footwell having swinging side panels on each vertical surface providing stability in the water and increased surface when forced rearwardly, also said side panels folding flat against the fin when slid forward providing the same relative action as said propulsion flaps.

7. A buoyant device for walking on the surface of water comprising:

(a) a pair of hulls having a length longer than their width, and each having sufficient buoyancy to support the weight of a person while standing on the hulls in the water, (b) a plurality of hinged rearwardly swinging propulsion flaps having their length parallel to the hull length and further having upwardly depending side legs on edges thereof parallel with the hull, each propulsion flap creating a cup-like resistance chamber when urged forward by the action of a person's feet in a walking motion alternatively allowing one hull to slide forward effortlessly and the other to resist the water on the flaps, propelling the wearer forward, said propulsion flaps further comprise a removable hinge allowing each flap to be independently removed for replacement or repair, (c) a footwell in each hull having a top and a bottom, the footwell being wider and longer than a person's foot and disposed through an upper surface of the hull with the bottom below the water line near the hull center of gravity, further the footwell is narrower at the top than the bottom such that a person's foot may enter and yet provide support for a person's ankle, thereby decreasing the susceptibility of tipping.

(d) a resilient shoe having attaching means, removably fastened to the bottom of each footwell providing means to maintain a person's foot therein and yet allow freedom of movement for the walking activity creating propulsion for the device, and, (e) a propulsion fin disposed under each footwell having swinging side panels on each vertical surface providing stability in the water and increased surface when forced rearwardly, also said side panels folding flat against the fin when slid forward providing the same relative action as said propulsion flaps.

8. A buoyant device for walking on the surface of water comprising:

(a) a pair of hulls having a length longer that their width, and each having sufficient buoyancy to support the weight of a person while standing on the hulls in the water.

(b) a plurality of hinged rearwardly swinging propulsion flaps having their length parallel to the hull length and further having upwardly depending side legs on edges thereof parallel with the hull, each propulsion flap creating a cup-like resistance chamber when urged forward by the action of a person's feet in a walking motion alternatively allowing one hull to slide forward effortlessly and the other to resist the water on the flaps, propelling the wearer forward, at least one detent sanp disposed within said propulsion falp and at least one mating detent receptacle attached to said hull allowing the flaps to be detachably joined to the hull in a contiguous manner for storage and handling of the device, (c) a footwell in each hull having a top and a bottom, the footwell being wider and longer than a person's foot and disposed through an upper surface of the hull with the bottom below the water line near the hull center of gravity, further the footwell is narrower at the top than the bottom such that a person's foot may enter and yet provide support for a person's ankle, thereby decreasing the susceptibility of tipping.

(d) a resilient shoe having attaching means, removably fastened to the bottom of each footwell providing means to maintain a person's foot therein and yet allow freedom of movement fo the walking activity creating propulsion for the device, and, (e) a propulsion fin disposed under each footwell having swinging side panels on each vertical surface providing stability in the water and increased surface when forced rearwardly, also said side panels folding flat against the fin when slid forward providing the same relative action as said propulsion flaps.

9. The buoyant device as recited in claim 1 wherein said resilient shoe is configured in such a manner as to allow the dorsum of one's foot to be free permitting disengaging without damage or injury in the event of the necessity of expeditious release therefrom.

10. The buoyant device as recited in claim 1 wherein said resilient shoe further comprises a hook and loop tape closure affixed to an upper most portion around a wearer's ankle having the capability of quick unassisted release when falling or manual disengagement separating the hook portion from the loop portion for detachment therefrom.

11. A buoyant device for walking on the surface of water comprising:

(a) a pair of hull having a length longer than their width, and each having sufficient buoyancy to support the weight of a person while standing on the hulls in the water.

(b) a plurality of hinged rearwardly swinging propulsion flaps having their length parallel to the hull length and further having upwardly depending side legs on edges thereof parallel with the hull, each propulsion flap creating a cup-like resistance chamber when urged forward by the action of a person's feet in a walking motion alternatively allowing one hull to slide foward effortlessly and the other to resist the water on the flaps, propelling the wearer foward.

(c) a footwell in each hull having a top and a bottom, the footwell being wider and longer than a person's foot and disposed through an upper surface of the hull with the bottom below the water line near the hull cetner of gravity, further the footwell is narrower at the top than the bottom such that a person's foot may enter and yet provide support for a person's ankle, thereby decreasing the susceptibility of tipping.

(d) a resilient shoe having attaching means, removably fastened to the bottom of each footwell providing means to maintain a person's foot therein and yet allow freedom of movement for the walking activity creating propulsion for the device, said resilient shoe further comprising an integral resilient spring like U-shaped rear ankle support disposed within the uppermost portion of the shoe distending partially around the wearer's ankle allowing quick unassisted release when falling or forceably separating the support to release the shoe from the wearer, and, (e) a propulsion fin disposed under each footwell having swinging side panels on each vertical surface providing stability in the water and increased surface when forced rearwardly, also said side panels folding flat against the fin when slid forward providing the same relative action as said propulsion flaps.

12. A buoyant device for walking on the surface of water comprising:

(a) a pair of hulls having a length longer than their width, and each having sufficient buoyancy to support the weight of a person while standing on the hulls in the water.

(b) a plurality of hinged rearwardly swinging propulsion flaps having their length parallel to the hull length and further having upwardly depending side legs on edges thereof parallel with the hull, each propulsion flap creating a cup-like resistance chamber when urged forward by the action of a person's feet in a walking motion alternatively allowing one hull to slide foward effortlessly and the other to resist the water on the flaps, propelling the wearer forward.

(c) a footwell in each hull having a top and a bottom, the footwell being wider and longer than a person's foot and disposed through an upper surface of the hull with the bottom below the water line near the hull center of gravity, further the footwell is narrower at the top than the bottom such that a person's foot may enter and yet provide support for a person's ankle, thereby decreasing the susceptibility of tipping.

(d) a resilient shoe having attaching means, removably fastened to the bottom of each footwell providing means to maintain a person's foot therein and yet allow freedom of movement for the walking activity creating propulsion for the device, said resilient shoe attaching means further comprising an upstanding stud within a forward portion of the footwell and said shoe having a notch in a forwardmost part thereof with a removable wingnut affixing the shoe to the stud for forward attachment, also a hole in each side of the shoe and a pair of overextending side clamps having a threaded bore therein, one on each side permanently attached to the opposed bottom side portions of the footwell with a thumbscrew penetrating each bore through said hole in the shoe for side attachment thereof, and, (e) a propulsion fin disposed under each footwell having swinging side panels on each vertical surface providing stability in the water and increased surface when forced rearwardly, also said side panels folding flat against the fin when slid forward providing the same relative action as said propulsion flaps.

13. The buoyant device as recited in claim 1 wherein said propulsion fin is removable to facilitate transportation and storage.

14. The buoyant device as recited in claim 1 further comprising a covered storage compartment within each hull for stowing ancillary gear therein.

15. The buoyant device as recited in claim 1 further comprising a hull mooring member on the stern of each hull of fastening the hull to a secure object.

16. The buoyant device as recited in claim 15 further comprising an ankle tether attached on one end to said hull mooring member and on the other to the user's ankle to maintain communication with said hull in the event that the user falls into the water.

17. The buoyant device as recited in claim 1 further comprising a pair of handles on said hulls for attaching the hulls together for stability when entering and to grasp in the event that the user falls in the water, also for ease of handling out of the water.

18. The buoyant device as recited in claim 17 further comprising a connecting strap joined on each end to said handles attaching the hulls together.

19. The buoyant device as recited in claim 1 further comprising a one-way check valve disposed between the bottom of the footwell and an underside surface of said hull allowing water trapped inside the footwell to be drained by lifting one hull above the water.

20. A buoyant device for walking on the surface of water comprising:

(a) a pair of hulls having a length longer than their width, and each having sufficient buoyancy to support the weight of a person while standing on the hulls in the water.

(b) a plurality of hinged rearwardly swinging propulsion flaps having their length parallel to the hull length and further having upwardly depending side legs on edges thereof parallel with the hull, each propulsion flap creating a cup-like resistance chamber when urged forward by the action of a person's feet in a walking motion alternatively allowing one hull to slide forward effortlessly and the other to resist the water on the flaps, propelling the wearer forward.

(c) a footwell in each hull having a top and a bottom, the footwell being wider and longer than a person's foot and disposed through an upper surface of the hull with the bottom below the water line near the hull center of gravity, further the footwell is narrower, at the top than the bottom such that a person's foot may enter and yet provide support for a person's ankle, thereby decreasing the susceptibility of tipping.

(d) a resilient shoe having attaching means, removably fastened to the bottom of each footwell providing means to maintain a person's foot therein and yet allow freedom of movement for the walking activity creating propulsion for the device.

(e) a propulsion fin disposed under each footwell having swinging side panels on each vertical surface providing stability in the water and increased surface when forced rearwardly, also said side panels folding flat against the fin when slid forward providing the same relative action as said propulsion flaps, and (f) flap securing means having a pair of keepers embedded into said hull adjacent to a pair of flaps and a tension member stretched therebetween in such a manner as to hold all of the flaps in a retracted position for transportation and storage.

21. The buoyant device as recited in claim 1 further comprising a removable stabilizing arm upstanding from each hull forwardly adjacent to said footwell providing a support handle for grasping to assist in stabilizing the hulls when walking on the surface of water.

22. The buoyant device as recited in claim 1 further comprising a removable seat mounted into one of the hulls rearwardly adjacent to said footwell providing a chair-like structure to sit upon for testing.

23. The buoyant device as recited in claim 1 further comprising a hand grip disposed on each hull rearward of the footwell providing a gripping surface for a user to employ when mounting the device when in the water.

24. A buoyant device for walking on the surface of water comprising:

(a) a pair of hulls having a length longer than their width, and each having sufficient buoyancy to support the weight of a person while standing on the hulls in the water, (b) a plurality of hinged rearwardly swinging propulsion flaps having their length parallel to the hull length and further having upwardly depending side legs on edges thereof parallel with the hull, each propulsion flap creating a cup-like resistance chamber when urged forward by the action of a person's feet in a walking motion alternatively allowing one hull to slide foward effortlessly and the other to resist the water on the flaps, propelling the wearer forward, (c) a footwell in each hull having a top and a bottom, the footwell being wider and longer than a person's foot and disposed through an upper surface of the hull with the bottom below the water line near the hull center of gravity, further the footwell is narrower at the top than the bottom such that a persons's foot may enter and yet provide support for a person's ankle, thereby decreasing the susceptibility of tipping, (d) a resilient shoe having attaching means, removably fastened to the bottom of each footwell providing means to maintain a persons's foot therein and yet allow freedom of movement for the walking activity creating propulsion for the device, and (e) a downwardly extending fin disposed under each footwell providing a stabilizing effect to the device helping to prevent roll when walking on the surface of water.

* * * * *